US005964964A

United States Patent [19]

Kurebayashi et al.

[11] Patent Number: 5,964,964

[45] Date of Patent: Oct. 12, 1999

[54] WELDED JOINT OF HIGH FATIGUE STRENGTH

[75] Inventors: Katsumi Kurebayashi, Futtsu; Syuji Aihara, Tokai; Hidesato Mabuchi, Oita; Naoki Saito, Futtsu, all of Japan

[73] Assignee: Nippon Steel Corporation, Tokyo, Japan

[21] Appl. No.: 08/930,295

[22] PCT Filed: Aug. 16, 1996

[86] PCT No.: PCT/JP96/02308

§ 371 Date: Oct. 3, 1997

§ 102(e) Date: Oct. 3, 1997

[87] PCT Pub. No.: WO97/30184

PCT Pub. Date: Aug. 21, 1997

[30] Foreign Application Priority Data

Feb. 13, 1996 [JP] Japan ..... 8-025199
Dec. 3, 1996 [JP] Japan ..... 8-055016

[51] Int. Cl.[6] ..... C22C 38/04; C22C 38/06

[52] U.S. Cl. ..... 148/320; 228/262.41

[58] Field of Search ..... 148/320, 332–336, 148/902; 228/262.41; 428/683; 420/89–91

[56] References Cited

FOREIGN PATENT DOCUMENTS

| | | |
|---|---|---|
| 63-7328 | 1/1988 | Japan . |
| 63-57741 | 3/1988 | Japan . |
| 2-77523 | 3/1990 | Japan . |
| 4-268040 | 9/1992 | Japan . |
| 6-207241 | 7/1994 | Japan . |
| 6-240406 | 8/1994 | Japan . |

OTHER PUBLICATIONS

Journal of The Iron and Steel Institute of Japan, vol. 71, No. 13, Sep. 1985, p. 1511.

Journal of The Iron and Steel Institute of Japan, vol. 61, No. 11, Sep. 1975, pp. 2589–2603.

*Primary Examiner*—Deborah Yee

*Attorney, Agent, or Firm*—Kenyon & Kenyon

[57] ABSTRACT

A propagation speed of a fatigue crack in a HAZ is restricted, and a fatigue strength of an as-welded joint can be improved, by limiting an area ratio of a ferrite micro-structure in the HAZ of the welded joint to 20 to 100% and the balance to one of a bainite, a martensite, a pearlite and a residual austenite micro-structure, or limiting a carbon equivalent of a steel plate used for the welded joint to not greater than 0.275.

6 Claims, 2 Drawing Sheets

WELDED JOINT OF HIGH FATIGUE STRENGTH

BACKGROUND OF THE INVENTION

1. Field of the Invention

This invention relates to a welded joint having an excellent fatigue strength which is mainly used for welded structures such as ships, offshore structures, bridges, building machines, and so forth. More particularly, the present invention relates to a welded joint having an improved fatigue strength by increasing the area ratio of a ferrite micro-structure capable of retarding a propagation speed of a fatigue crack in a weld heat affected zone (hereinafter abbreviated as the "HAZ") of a welded joint.

2. Description of the Related Art

As the sizes of buildings have become greater, a reduction in the weight of structural members has become an important subject in recent years, and the strength of steels used for such structures has become higher and higher for accomplishing this object. However, since a load is repeatedly applied to the welded joint during use in ships, offshore structures, bridges, building machines, and so forth, countermeasures must be taken to prevent fatigue destruction in such structures. It is at the welded joint portion that this fatigue destruction is most likely to develop. Therefore, an improvement in the fatigue strength of the welded joint has been required.

Intensive studies have been made to this date on the factors deciding the fatigue strength of the welded joint and an improvement of the fatigue strength. However, most of the proposals include an improvement by additional execution after welding such as grinding by a grinder, shaping the end portion of the weld bead final layer by heating and refusing, shot peening to generate compressive stress at the weld end portion (Japanese Unexamined Patent Publication (Kokai) No. 59-110490 and No. 1-301823), and so forth. The reduction of the residual stress by post heat-treatment after welding is also well known in the art.

A method which improves the fatigue strength of the weld portion even in the as-welded state by means of components of the steel material without using a specific execution or post heat-treatment after welding as described above has also been proposed.

In order to make the formation of clean polygonal ferrite advantageous by an addition of Si, to strengthen the steel by an addition of B and to improve hardenability to thereby obtain an excellent elongation flange property, fatigue characteristics and resistance weldability, Japanese Unexamined Patent Publication (Kokai) No. 3-264645 discloses a high strength steel sheet having excellent elongation flange property, etc., which contains 0.01 to 0.2% of C, 0.6 to 2.5% of Mn, 0.02 to 1.5% of Si and 0.0005 to 0.1% of B.

Japanese Examined Patent Publication (Kokoku) No. 3-56301 discloses a ultra-low carbon steel sheet having excellent spot weldability which contains not greater than 0.006% of C, not greater than 0.5% of Mn,. not greater than 0.05% of Al and 0.001 to 0.100% of at least one of Ti and/or Nb, in total, with the proviso that nitrides and sulfides are not calculated, so as to advantageously improve the joint fatigue strength of the spot welded portion by elaborating the steel components, especially by an addition of B, and the proportion of un-recrystallized structure in the steel.

Japanese Unexamined Patent Publication (Kokai) No. 6-207245 discloses a multi-layered steel plate having excellent fatigue characteristics by means of an addition of Ni to a steel material surface layer to generate a residual stress of compression at a weld end portion so as to increase the time until the occurrence of a fatigue crack, and wherein the addition amount of Ni is at least 3% inside the region spaced apart by at least 0.2 mm from both surfaces of the steel plate and being not greater than 25% of the thickness.

Japanese Unexamined Patent Publication (Kokai) No. 6-228707 discloses a structural steel having excellent weld joint fatigue characteristics, and a welding method therefor, which contains 0.001 to 0.01% of C, 0.005 to 0.05% of Si and 0.5 to 2% of Cu and having a Ceq of not greater than 0.2. This reference invention makes uniform the hardness distribution in the proximity of the weld end portion by using fine precipitation of Cu while reducing Ceq to prevent concentration of plastic deformation, and reduces the residual stress of the weld end portion functioning as a mean stress by eliminating HAZ hardening through the reduction of Ceq.

Among these prior art references, Japanese Unexamined Patent Publication (Kokai) No. 59-110490 and Japanese Unexamined Patent Publication (Kokai) No. 1-301823 require a specific execution after welding, and cannot improve the fatigue strength in the as-welded state. The method using the heat-treatment after welding is not preferable, either, because the number of the process steps increases and execution of welding becomes complicated. Further, its effect is limited.

The thin steel sheet described in Japanese Unexamined Patent Publication (Kokai) No. 3-264645 relates to a base material of steel sheet which is mainly directed to wheels and discs of automobiles. Since this steel sheet is entirely different in application, the thickness and the method of use from the steel plate used for ship-building, offshore structures, etc., to which the present invention is directed, the observation described in this reference cannot be applied as such to the thick steel plate. Further, since this reference does not at all describe the welded joint, the influences on the fatigue strength of the welded joint are not at all examined. Further, it is not clear whether or not the polygonal ferrite micro-structure, which is reportedly contained in the base metal, is generated in the HAZ.

The steel sheet disclosed in Japanese Examined Patent Publication (Kokoku) No. 3-56301 relates to the spot weld portion of a ultra-low carbon steel sheet, and contemplates to control the hardness distribution of the spot weld portion. Spot welding is one of the resistance welding methods which clamps the weld portion of a steel sheet under pressure by electrodes, and causes a large current to flow through the weld portion within a short time. In contrast, the welding method of the welded joint as the object of the present invention is mainly a welding method used for welding steel plates having a large thickness. Therefore, these welding methods are different from each other not only in the welding residual stress but also in the welding conditions such as the shape of the electrodes, the existence of a welding material, and so forth. Because the factors governing the fatigue strength are different between spot welding of a thin sheet and welding of a thick steel plate, the observation of spot welding cannot be applied as such to the welding method of a thick steel plate.

The steel plate described in Japanese Unexamined Patent Publication (Kokai) No. 6-207245 has the same application because it is a structural steel. However, since this reference limits to a Ni-containing multi-layered steel, the fatigue strength cannot be improved in the ordinary single-layered steel. It is not obvious from this reference whether or not the fatigue strength of the welded joint can be improved.

The invention disclosed in Japanese Unexamined Patent Publication (Kokai) No. 6-228707 does not describe the HAZ structure of the weld joint, and the relation between the micro-structure and the fatigue strength is not clear, either. Therefore, this reference invention is different from the present invention. Further, the C addition amount and the Si addition amount are as small as not greater than 0.01% and not greater than 0.05%, respectively. Since the reference invention essentially requires the addition of Cu, it is different from the present invention.

SUMMARY OF THE INVENTION

It is an object of the present invention to provide a welded joint having an excellent fatigue strength in an as-welded state by increasing the area ratio of a ferrite micro-structure, which can retard the propagation speed of a fatigue crack, in the HAZ of a welded joint, without employing means for improving the fatigue strength by executing an additional welding work to reduce a stress concentration after welding.

The principle of the present invention for accomplishing the object describe above can be summarized as follows.

(1) The fatigue strength of the welded joint is improved by increasing an area ratio of a ferrite micro-structure capable of retarding a propagation speed of a fatigue crack in the HAZ of a welded joint.

(2) The fatigue strength of the welded joint is improved by increasing the area ratio of the ferrite micro-structure in the HAZ of the welded joint by limiting the chemical compositions of a steel plate and its carbon equivalent.

(3) The fatigue strength of the welded joint is improved by increasing the area ratio of the ferrite micro-structure in the HAZ of the welded joint by having a fine HAZ micro-structure by adding a suitable amount of Ti and N.

The present invention improves the fatigue strength of the welded joint by the effect of the item (1), and can attain a higher fatigue strength by further combining the above item (2) or (3).

In other words, the gist of the present invention resides in the following points.

① A welded joint having an excellent fatigue strength characterized in that the area ratio of a ferrite micro-structure in a heat affected zone (HAZ) of the welded joint is from 20 to 100%, and the balance comprises at least one of a bainite, a martensite, a pearlite and a residual austenite micro-structure.

② A welded joint having an excellent fatigue strength according to the item ①, which is produced by using a steel plate containing, in terms of percent by weight:

C: 0.015 to 0.15%,

Si: 0.06 to 2.0%,

Mn: 0.2 to 1.5%,

P: not greater than 0.05%,

S: not greater than 0.05%,

Al: 0.001 to 0.08%,

N: 0.002 to 0.015%, and the balance of Fe and unavoidable impurities;

and having a carbon equivalent (Ceq) of not greater than 0.275:

$$Ceq=C+Mn/6+(Cu+Ni)/15+(Cr+Mo+V)/5+Nb/3.$$

③ A welded joint having an excellent fatigue strength according to the item ②, which is produced by using a steel plate further containing, in terms of percent by weight:

Ti: 0.003 to 0.05%.

④ A welded joint having an excellent fatigue strength according to the item ③, which is produced by a steel plate having a value Ti/N is 2.0 to 3.4.

⑤ A welded joint having an excellent fatigue strength according to one of the items ② to ④, which is produced by using a steel plate further containing, in terms of percent by weight, at least one of the following members:

Cu: 0.1 to 2.0%,

Ni: 0.1 to 2.0%,

Cr: 0.05 to 1.0%,

Mo: 0.02 to 1.0%,

V: 0.005 to 0.10%, and

Nb: 0.005 to 0.08%. ⑥ A welded joint having an excellent fatigue strength according to one of the items ② to ⑤, which is produced by using a steel plate further containing, in terms of percent by weight:

Ca: 0.0005 to 0.010%, and

REM: 0.0050 to 0.050%.

DESCRIPTION OF THE PREFERRED EMBODIMENTS

Figure 1A:
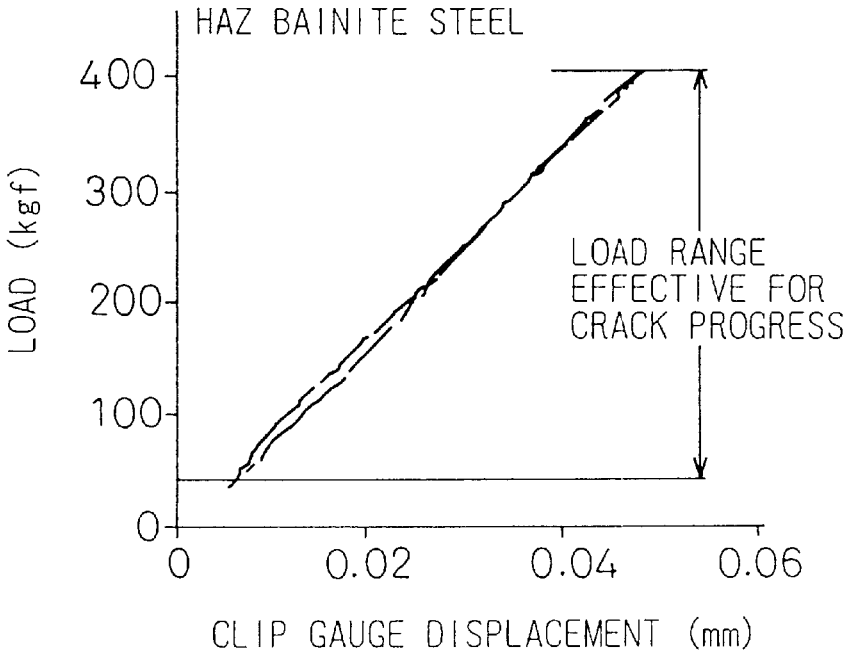
FIG. 1(A) is a diagram showing the relation between displacement of a crack opening and the change of load in a HAZ bainite steel.

The technical concept of the present invention and the reasons for limitation will be described in detail in the following items (1) and (2).

(1) First of all, the reason why the micro-structure in a HAZ of a welded joint is limited will be described.

The inventors of the present invention have examined the importance of the HAZ for improving the fatigue strength of a welded joint.

Generally, the fatigue destruction of a welded structure occurs in most cases at a welded joint portion having a structural stress concentration. In a normal weld portion devoid of a welding defect and scratches in a steel plate, a fatigue crack occurs in many cases from the HAZ as the boundary between a base metal having a local stress concentration and a weld metal, propagates inside the HAZ, then propagates to the base metal and finally results in destruction which spoils the functions of the structure.

Therefore, the present inventors have examined the proportion of occurrence-propagation life of the fatigue crack in the HAZ to total destruction life. Three kinds of joints, that is, a T-type fillet-welded joint, a cruciform fillet-welded joint and a boxing welded joint, that are widely used for structures, were used. When a strain gauge was bonded at a position spaced apart inward by 5 to 10 mm from the boundary, between the base metal and the weld metal, to the base metal (depending on the kind of the joint) and the strain value in the repeated load was measured, the number of repetitions at the point when the strain value dropped by 5% from the strain value at the start of the test was substantially coincident with the number of repetitions of the distal end of the fatigue crack which passed through the HAZ and reached the base metal. Therefore, this number of repetitions was defined as the "occurrence propagation life" in the HAZ. As a result of the fatigue test of the weld joints, the proportion of the occurrence propagation life of the fatigue crack in the HAZ to the total life resulting finally in destruction was about 70% in the T-type fillet-welded joint, about 80% in the cruciform fillet-welded joint and about 40% in the boxing welded joint.

The test described above clarified that the occurrence life of the fatigue crack to the total fatigue life occupied a considerable proportion to the total fatigue life. Once the crack started propagating, on the other hand, its restriction was extremely difficult. In order to improve the fatigue strength of the welded joint, therefore, it is believed effective either to make the occurrence of the fatigue crack in the HAZ difficult or to retard as much as possible the propagation of the fatigue crack in the HAZ even when the fatigue crack occurs.

Next, the inventors of the present invention have examined the micro-structure of the HAZ in connection with the fatigue strength, and have acquired the following important observation.

Generally, the HAZ structure of steel plates used for ships, offshore buildings, bridges and building machines mainly comprises a bainite micro-structure in the case of a tensile strength in the order of 400 to 580 MPa, and a bainite micro-structure or a martensite structure when the tensile strength exceeds 580 MPa. Depending on the components of the steel plate and its heat-treatment, the pearlite micro-structure and the residual austenite micro-structure are contained in some cases in addition to these micro-structures. The HAZ micro-structure is not much affected by the base metal structure but is rather determined by the chemical compositions of the steel plate and the cooling rate at the time of welding. Therefore, even in the case of mild steels for welding micro-structures of a 400 MPa class (for example, 0.14%C–0.2%Si–0.9%Mn) that are used ordinarily, the carbon equivalent as an index of hardenability is high under the ordinary welding condition of not higher than 50 KJ/cm, so that the HAZ hardly comprises a ferrite micro-structure as the main structure.

The inventors of the present invention believe it necessary to examine the fatigue crack propagation speed in the HAZ of the respective micro-structure in order to examine the fatigue strength of the welded joint. To examine the influences of the micro-structures under the same dynamic condition without the influences of dynamic factors such as a stress concentration coefficient, a residual stress and so forth, the present inventors have conducted the crack propagation test by using small simulated HAZ testpieces. As a simulated heat cycle for welding, the highest heating temperature was set to 1,400° C. and the cooling time from 800 to 500° C. was set to 1 to 161 seconds. The ferrite micro-structure, the bainite structure and the martensite micro-structure were reproduced by the differences of the chemical components and the cooling speed. Each testpiece was a 3-point bending crack propagation test-piece having a size of 20×10×100 mm and having a 6 mm-long sharp notch, and a stress ratio was 0.1. Crack opening displacement was measured by a clip gauge, and the crack length was calculated by a compliance method.

As a result of the crack propagation test, it was found out that propagation life of the fatigue crack when the HAZ was ferrite structure was improved by at least two times the fatigue crack when the HAZ was the bainite micro-structure and the martensite micro-structure. When the stress expansion coefficient range and the crack propagation speed were examined, the difference due to the difference of the micro-structures could not be observed when the crack length was already long and the stress expansion coefficient range was high, but when the crack length was still small and the stress expansion coefficient range was low, the difference due to the micro-structure appeared. When the area ratio of the ferrite micro-structure in the HAZ was high, the crack propagation speed dropped remarkably.

Figure 1B:
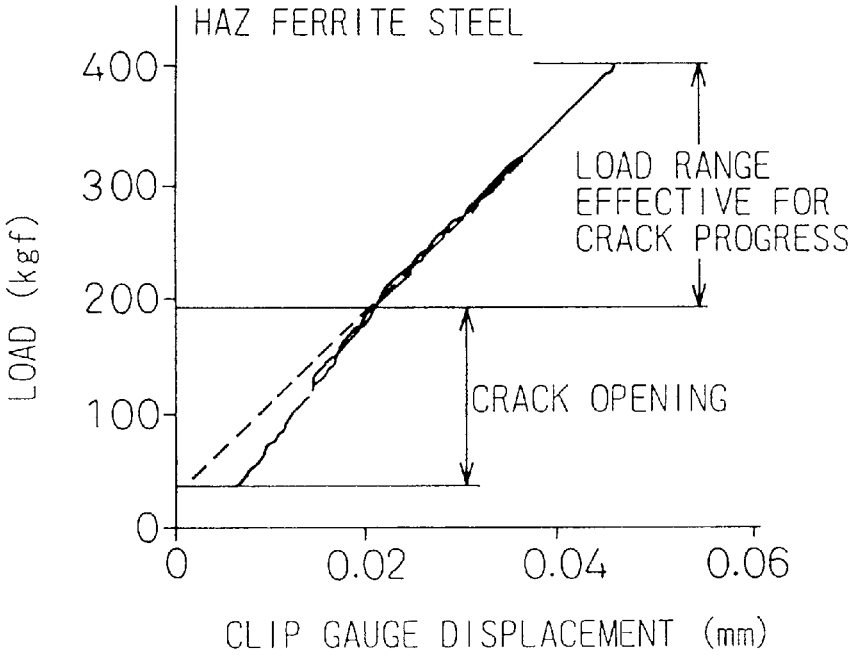
FIG. 1(B) is a diagram showing the relation between displacement of a crack opening and the change of load in a HAZ ferrite steel.

Further, FIG. 1(A) and FIG. 1(B) show the result of the detailed observation of the crack opening displacement and the change of the load in a HAZ bainite steel having a ferrite micro-structure area ratio in the HAZ of 2% and in an 88% HAZ ferrite steel. When the proportion of the ferrite micro-structure became high, a remarkable crack closure was observed. The term "crack closure" used herein means the phenomenon in which the distal end of the fatigue crack exceeds a yield point and undergoes plastic deformation at the maximum load, and closes before the minimum load. In comparison with other micro-structures, the proportion of dislocation strengthening of the ferrite micro-structure is smaller, and this structure is extremely mild and easily undergoes plastic deformation. Therefore, the crack opening is believed to easily occur. When this crack opening occurs, the propagation of the fatigue crack does not occur when the distal end of the fatigue crack is closed, and the stress range effective for the propagation of the fatigue crack decreases. In consequence, propagation life in the HAZ is believed to become longer when the HAZ comprises the ferrite micro-structure.

On the basis of the technical concept described above, the present invention improves the fatigue strength of the welded joint by increasing the area ratio of the ferrite micro-structure capable of retarding the propagation speed of the fatigue crack in the HAZ of the welded joint.

However, grain boundary ferrite occurring with an area ratio of less than 20% in the grain boundary of the bainite micro-structure cannot improve the fatigue strength even when the propagation is retarded because the fatigue crack easily occurs from the grain boundary ferrite, though it is included into the category of the ferrite micro-structure. When the area ratio of the ferrite micro-structure of the HAZ is less than 20%, the improvement of the fatigue strength cannot be expected even when closure of the fatigue crack occurs because this closure is extremely small.

In order to improve the fatigue strength of the welded joint, therefore, it is necessary to secure at least 20% of the area ratio of the ferrite micro-structure in the HAZ. When the area ratio of the ferrite micro-structure is at least 20% in the HAZ, there occurs no problem even when bainite, martensite, pearlite and residual austenite micro-structures are contained. To further stably improve the fatigue strength, the area ratio of the ferrite micro-structure in the HAZ is preferably at least 60%, and its upper limit value is 100%.

Here, the area ratio of the micro-structure is defined as the value obtained by cutting each welded joint in such a manner as to contain the weld metal, the HAZ and the base metal, observing the polished surface by an optical microscope, and counting the proportion of each micro-structure in a region extending from a position of about 50 $\mu$m from the weld metal towards the HAZ to the boundary line between the HAZ and the base metal by a point counting method.

(2) Next, the reasons for the limitation of the chemical components of the steel plate used for the welded joint and the carbon equivalent will be described.

First, each element limited as the basic chemical composition of the steel plate will be explained.

Carbon (C) is the element which improves the strength of the base metal, and a large amount of C is preferably added to improve the strength of the base metal. When C is added in an amount exceeding 0.15%, however, hardenability becomes so high that the ferrite micro-structure in the HAZ cannot be obtained, and weldability and toughness of the weld portion drop. Therefore, the upper limit of C is set to 0.15%. When the C content is less than 0.015%, the strength of the base metal as the structural steel cannot be secured easily. Therefore, the lower limit of C is set to 0.015%.

Silicon (Si) is the element necessary for deoxidation at the time of steel making. When added in a suitable amount, Si reinforces the matrix by solid solution. If the Si content is less than 0.06%, the deoxidation effect drops at the time of steel making. Therefore, the lower limit is set to 0.06%. Si is also a ferrite formation element and is not contained in the formula of the carbon equivalent. When added in an amount of at least 0.6%, therefore, Si provides the effect of increasing the area ratio of the ferrite micro-structure in the HAZ at the same carbon equivalent. When added in an amount exceeding 2.0%, on the other hand, Si merely increases hardenability and the toughness drops. Therefore, the upper limit is set to 2.0%.

Manganese (Mn) is the element which increases the base metal strength without greatly lowering the toughness. If the Mn content is less than 0.2%, a sufficient base metal strength cannot be obtained, and S brittleness is likely to occur. Therefore, the lower limit is set to 0.2%. If the Mn content exceeds 1.5%, on the other hand, hardenability becomes so high that the ferrite structure cannot be obtained in the HAZ, the toughness of the weld portion drops, and weldability as well as ductility are deteriorated. Therefore, the upper limit is set to 1.5%.

The P (phosphorus) content is preferably as small as possible. When added in an amount exceeding 0.05%, P undergoes segregation in the grain boundary of the base metal and invites grain boundary brittleness. Therefore, the upper limit is set to 0.05%.

The S (sulphur) content is preferably as small as possible. When added in an amount exceeding 0.05%, A type inclusions become remarkable, spoil the toughness of the base metal and the weld portion, and lower ductility in the direction of the thickness of the steel plate. Therefore, the upper limit is set to 0.05%.

Aluminum (Al) is used as a deoxidation element. When other elements are used as the deoxidation elements, the lower limit is set to 0.001% because Al is generally contained in an amount of at least 0.001%. When added in an amount exceeding 0.08%, large quantities of Al oxides and nitrides are formed and deteriorate the toughness of the weld portion. Therefore, its upper limit is set to 0.08%.

Nitrogen (N) is contained at least 0.002% as an impurity in the steel. Therefore, the lower limit of N is set to 0.002%. When contained in an amount exceeding 0.015%, on the contrary, N undergoes solid solution in the ferrite and lowers the toughness. Therefore, its upper limit is set to 0.015%. Further N causes the interaction with Ti, which will be described next.

Titanium (Ti) promotes the formation of the ferrite micro-structure in the HAZ micro-structure, Ti nitrides restrict coarsening of the HAZ structure, lower hardenability because the crystal grains become finer. When the proportion of addition of Ti and N, that is, the Ti/N value, is less than 2.0, N becomes excessive, undergoes solid solution in ferrite and lowers the toughness. When the Ti/N value exceeds 3.4, the formation of the Ti nitrides gets into saturation, and the toughness drops due to Ti carbides. Therefore, the Ti/N ratio is preferably within the range of 2.0 to 3.4. When the addition amount of Al is small, Ti and N serve as the deoxidation elements, and the resulting Ti oxides function as the formation nucleus of inter-granular ferrite in the HAZ and improve the area ratio of the ferrite micro-structure. The lower limit of Ti, which provides a remarkable effect of forming the ferrite micro-structure is set to 0.003%. When added in an amount exceeding 0.05%, Ti produces a large amount of precipitates and lowers the toughness. Therefore, the upper limit is set to 0.05%.

The Ti oxides and the Ti nitrides may include $Ti_2O_3$, TiN, TiO, $(Ti, Al)_xO_y$, $Ti_x(O, N)_y$, etc., but in order to promote the formation of the ferrite micro-structure of the HAZ, it is preferred to finely disperse $Ti_2O_3$ having a grain size of 0.1 to 3.0 $\mu$m and the number of grains of $5\times10^4$ to $1\times10^6$ grains/mm$^2$ or to finely disperse TiN by adding $Ti_2O_3$ at a Ti/N ratio of 2.0 to 3.4 into the base other than the HAZ.

Copper (Cu) has the effect of improving the base metal strength, and improves the fatigue strength by solid solution strengthening, though it does not form carbides. However, this effect cannot be obtained unless its amount is at least 0.1%, and when added in an amount exceeding 2.0%, Cu will result in the solidification crack of the slab. Therefore, the lower limit and upper limit of Cu are set to 0.1% and 2.0%, respectively.

Ni (nickel) not only improves the base metal strength but also drastically improves the toughness. The lower limit of the amount of addition providing such effects is set to 0.1%, and the upper limit is 2.0% because the effects get into saturation even when Ni is added in a greater amount.

Chromium (Cr) improves both the base metal strength and the toughness, and reinforces the HAZ micro-structure by forming its carbides and nitrides. It also improves the fatigue strength. To obtain these effects, at least 0.05% of Cr must be added. Even when Cr is added in an amount exceeding 1.0%, the effects get into saturation, and weldability is spoiled, on the contrary. Therefore, the lower and upper limits are set to 0.05% and 1.0%, respectively.

Molybdenum (Mo) improves not only the base metal strength but also the toughness, and exhibits the similar functions as those of Cr in that it forms the carbides and the nitrides. The lower limit value as the amount providing such effects is set to 0.02% and the upper limit as the amount at which the effects get into saturation is set to 1.0%.

Vanadium (V) forms carbides and provides the effects of improving the base metal strength and refining the particles. If the V content is less than 0.005%, these effects are not remarkable. Therefore, the lower limit is set to 0.005%. When V is added in an amount exceeding 0.10%, on the contrary, hardenability of the HAZ becomes so high that the area ratio of the ferrite micro-structure decreases. Therefore, the upper limit value is set to 0.10%.

Niobium (Nb) is the element which has the effect of improving the base metal strength. When a TMCP process is applied at the time of the manufacture of the steel plate, Nb restricts recrystallization during rolling. Therefore, at least 0.005% of Nb must be added. If the Nb content is too great, however, the toughness of the weld portion drops. Therefore, the upper limit of Nb is set to 0.08%.

Calcium (Ca) has the effects of fixing sulfides as the generation source of the fatigue crack and improving ductility. Such effects cannot be expected if the amount of addition is not greater than 0.0005%, and if the amount exceeds 0.010%, the toughness drops. Therefore, the lower and upper limits are set to 0.0005% and 0.010%, respectively.

Rare earth metals (REM) have the same function as those of Ca in fixing the sulfides as the generation source of the fatigue crack and improving ductility. In the HAZ, the REM (O, S) functions as the formation nucleus of inter-granular transformation and promotes the formation of the ferrite micro-structure. Preferably, REM (O, S) having a grain size of 0.1 to 3 $\mu$m and the number of grains of 10 to 100 grains/mm$^2$ is finely dispersed. Any elements are believed to exhibit similar effects so long as they are the rare earth metals (REM), and La and Ce are typical examples. In order to obtain the effect of the addition of the REM, at least 0.0050% in total must be added, and when they are added in an amount exceeding 0.050%, the effects get into saturation and it is not economical. Therefore, the lower and upper limits are set to 0.0050% and 0.050%, respectively.

Further, the reasons for the limitation of the carbon equivalent of the steel plate used for the welded joint will be explained.

When the cooling speed at the time of welding is the same, the relation between the HAZ micro-structure and the compositions of the steel plate can be expressed by using the formula of the carbon equivalent proposed by the IIW. The formula of the carbon equivalent (Ceq) and the effect of Nb considering to increase a hardenability is given by the following formula:

$$Ceq=C+Mn/6+(Cu+Ni)/15+(Cr+Mo+V)/5+Nb/3.$$

When the carbon equivalent exceeds 0.275 as in the conventional steel plates, the HAZ micro-structure is the bainite micro-structure or the martensite micro-structure. Therefore, it is difficult to obtain the ferrite micro-structure. To increase the area ratio of the ferrite micro-structure of the HAZ, therefore, the carbon equivalent must be first set to not greater than 0.275.

To obtain a higher fatigue strength by increasing the area ratio of the ferrite micro-structure of the HAZ, the carbon equivalent is preferably not greater than 0.25. If the carbon equivalent is less than 0.10, on the other hand, the sufficient base metal strength cannot be obtained, and the carbon equivalent of at least 0.10 is preferred.

The present invention improves the fatigue strength of the welded joint by increasing the area ratio of the ferrite micro-structure in the HAZ of the weld joint on the basis of the technical concept described above. Here, the steel plate used for the welded joint is preferably the steel plate stipulated as above, but when the portion at which the fatigue damage becomes the problem is obvious in advance from the shape of the welded joint or the stress load condition, the steel plate stipulated above may be applied to only the side which is exposed to the fatigue damage.

The present invention is particularly effective for the welded joints of the type in which the crack opening/closing behaviour is likely to occur due to the weld residual stress of compression as in the case of the T-type fillet-welded joint, but can also improve the fatigue strength for the welded joints such as the cruciform fillet-welded joint, the boxing welded joint, the butt welded joint, etc., in which crack opening occurs.

On the other hand, the present invention is particularly effective for gas shield arc welding such as arc welding (MIG) using an inert gas, arc welding (MAG) using a mixed gas, tungsten arc welding (TIG), etc., but the present invention can improve the fatigue strength even in arc welding with covered electrode or shielded metal arc welding (SMAW), submerged arc welding (SAW) and further in welded joints using small to medium heat input of 1 to 5 KJ/mm used ordinarily for welding heat input to large heat input of up to about 20 KJ/mm provided that the crack opening occurs.

EXAMPLE 1

Hereinafter, examples of the present invention will be described.

Fatigue tests were carried out so as to examine the relation between the area ratio of the ferrite micro-structure of the HAZ of the welded joint and the fatigue strength. Nineteen kinds of steels, in total, were melted by using a 50 Kg vacuum melting furnace. Since it was expected that the carbon equivalent was low and the strength of the base metal was insufficient, hot rolling of the cast slabs was carried out by controlled rolling and controlled cooling. In other words, after each slab was heated at 1,100° C. for 60 minutes, it was rough rolled into a sheet thickness three times the finish sheet thickness, and a drop in the temperature, down to an un-recrystallization point, was awaited. Thereafter, each slab was finish hot-rolled to the plate thickness of 6 to 30 mm, and as soon as hot rolling was finished, the plate was control-cooled down to 500° C. and was further cooled with air to room temperature. Then, each testpiece was collected, and the yield stress, the tensile strength and the total elongation of the base metal were measured.

Table 1 represents the chemical components of each of the steels produced, its carbon equivalent and mechanical properties.

Three kinds of welded joints, that is, the T-type fillet-welded joint, the cruciform fillet-welded joint and the boxing welded joint, were produced by using each of these steels. The same steel plate as the base metal was used as a rib plate used for welding, and each welding was conducted in one pass. The welding method was MAG welding using a $CO_2$ gas, and all of a coated electrode, a solid wire and a flux-cored wire could be used as the welding material. However, this example used a flux-cored wire for a 50 Kg steel. After welding, a testpiece for observing the micro-structure of the weld portion was cut out, and the ferrite micro-structure of the HAZ and its area ratio were determined by the point counting method.

The fatigue test was carried out at room temperature in the atmosphere, and at a stress ratio of 0.1 by a three-point bending in the case of the T-type fillet-welded joint and at a stress ratio of 0 in the case of the cruciform fillet-welded joint and the boxing welded joint.

TABLE 1

| Section | Steel | Chemical composition (wt %) C | Si | Mn | P | S | Al | N | Cu | Ni | Cr | Mo |
|---|---|---|---|---|---|---|---|---|---|---|---|---|
| Steel of the present invention | A | | | | | | | | | | | |
| | B | 0.02 | 1.91 | 0.90 | 0.021 | 0.008 | 0.035 | 0.002 | — | — | — | — |
| | C | 0.06 | 1.10 | 0.84 | 0.034 | 0.004 | 0.004 | 0.004 | — | — | — | — |
| | D | 0.02 | 1.25 | 1.44 | 0.005 | 0.031 | 0.076 | 0.012 | — | — | — | — |
| | E | 0.03 | 1.33 | 0.66 | 0.024 | 0.011 | 0.045 | 0.005 | 1.95 | — | — | — |
| | F | 0.02 | 1.53 | 0.72 | 0.021 | 0.011 | 0.031 | 0.004 | — | 1.80 | — | — |
| | G | 0.02 | 1.15 | 0.36 | 0.019 | 0.018 | 0.025 | 0.005 | — | — | 0.95 | — |
| | H | 0.03 | 1.31 | 0.30 | 0.017 | 0.022 | 0.028 | 0.006 | — | — | — | 0.95 |
| | I | 0.04 | 1.51 | 0.96 | 0.015 | 0.022 | 0.036 | 0.003 | — | — | — | — |
| | J | 0.03 | 1.41 | 0.78 | 0.022 | 0.017 | 0.045 | 0.004 | 0.11 | 0.12 | 0.06 | 0.03 |
| | K | 0.02 | 0.10 | 0.78 | 0.011 | 0.007 | 0.056 | 0.004 | — | — | — | — |
| | L | 0.09 | 0.57 | 0.78 | 0.011 | 0.007 | 0.001 | 0.010 | — | — | — | — |
| | M | 0.03 | 0.49 | 1.02 | 0.008 | 0.011 | 0.056 | 0.007 | — | — | — | — |
| | M2 | 0.03 | 0.49 | 1.02 | 0.008 | 0.011 | 0.001 | 0.002 | — | — | — | — |
| | N | 0.10 | 0.58 | 0.90 | 0.015 | 0.006 | 0.037 | 0.005 | — | — | — | — |
| | O | 0.06 | 0.41 | 0.78 | 0.012 | 0.007 | 0.045 | 0.004 | — | — | — | — |
| Comparative steel | P | 0.14 | 0.21 | 0.96 | 0.012 | 0.011 | 0.048 | 0.005 | — | — | — | — |
| | Q | 0.18 | 0.25 | 1.02 | 0.022 | 0.009 | 0.035 | 0.004 | — | — | — | — |
| | R | 0.16 | 0.15 | 1.20 | 0.023 | 0.012 | 0.024 | 0.003 | 0.12 | 0.14 | 0.07 | 0.04 |
| | S | 0.05 | 0.62 | 1.12 | 0.019 | 0.010 | 0.031 | 0.004 | 0.20 | 0.11 | 0.13 | 0.25 |

| Section | Steel | Chemical composition (wt %) V | Nb | Ti | Ca | REM | Carbon equivalent Ceq *1 | Ti/N | Mechanical properties *2 YP | TS | EL |
|---|---|---|---|---|---|---|---|---|---|---|---|
| Steel of the present invention | A | | | | | | | | | | |
| | B | — | — | — | — | — | 0.17 | — | 291 | 428 | 34.6 |
| | C | — | — | — | — | — | 0.20 | — | 313 | 447 | 28.9 |
| | D | — | — | — | — | — | 0.26 | — | 333 | 478 | 28.9 |
| | E | — | — | — | — | — | 0.27 | — | 358 | 532 | 26.4 |
| | F | — | — | — | — | — | 0.26 | — | 364 | 529 | 26.8 |
| | G | — | — | — | — | — | 0.27 | — | 358 | 512 | 27.4 |
| | H | — | — | — | — | — | 0.27 | — | 356 | 508 | 27.4 |
| | I | 0.090 | — | — | — | — | 0.22 | — | 332 | 474 | 28.8 |
| | J | 0.006 | — | — | — | — | 0.19 | — | 354 | 508 | 27.7 |
| | K | — | 0.079 | — | — | — | 0.18 | — | 305 | 407 | 36.1 |
| | L | — | — | 0.032 | — | — | 0.22 | 3.20 | 334 | 446 | 31.4 |
| | M | — | — | 0.015 | 0.0087 | — | 0.20 | 2.14 | 311 | 434 | 30.6 |
| | M2 | — | — | 0.015 | 0.0087 | — | 0.20 | 0.75 | 311 | 434 | 30.6 |
| | N | — | — | — | — | 0.0460 | 0.25 | — | 355 | 491 | 27.1 |
| | O | — | 0.006 | 0.004 | 0.0007 | 0.0059 | 0.19 | 1.00 | 348 | 479 | 28.9 |
| Comparative steel | P | — | — | — | — | — | 0.30 | — | 373 | 510 | 21.2 |
| | Q | — | — | — | — | — | 0.35 | — | 382 | 512 | 23.7 |
| | R | 0.011 | — | — | — | — | 0.40 | — | 403 | 579 | 18.4 |
| | S | 0.006 | 0.007 | 0.010 | 0.0010 | 0.0092 | 0.34 | 2.50 | 411 | 556 | 20.9 |

*1: Ceq = C + Mn/6 + (Cu + Ni)/15 + (Cr + Mo + V)/5 + Nb/3

*2: YP: Yield stress (MPa), TS: Tensile strength (MPa), EL: Total elongation (%)

Table 2 shows the symbols of the steel plates used, the thickness, the area ratio of the ferrite micro-structure in the HAZ, the total area ratio of the bainite/martensite/pearlite/residual austenite micro-structures, the shapes of the welded joints and the fatigue strength.

Figure 2:
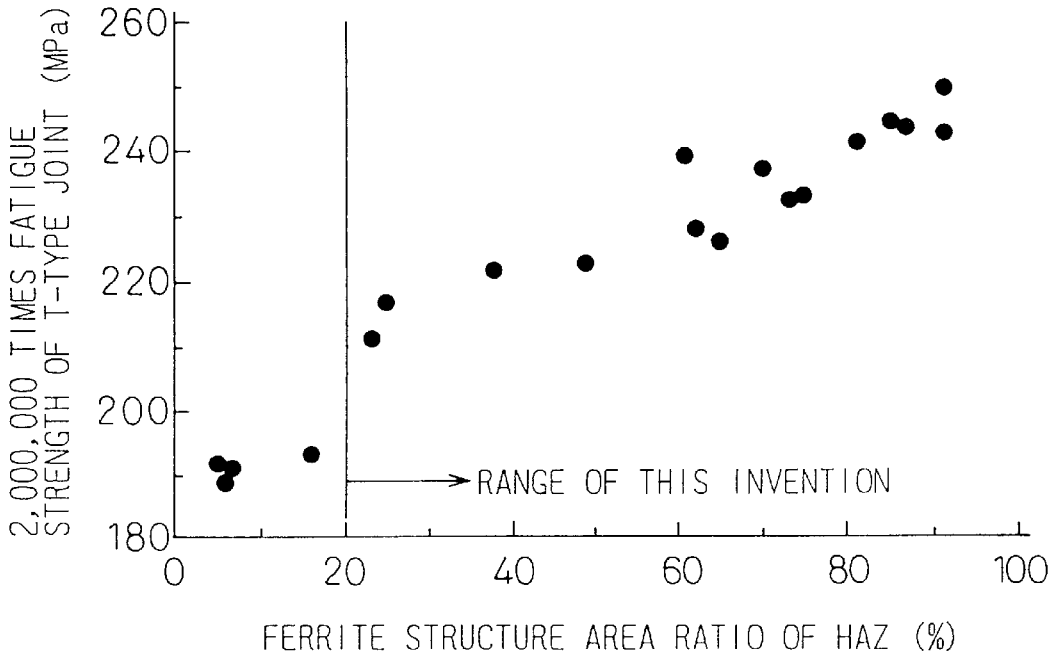
FIG. 2 is a diagram showing the relation between a ferrite micro-structure area ratio of a HAZ of a welded joint and the 2,000,000 times fatigue strength of a T-type fillet-welded joint.

FIG. 2 shows the relation between the area ratio of the ferrite micro-structure of the HAZ and 2,000,000 times fatigue strength of the T-type fillet-welded joint.

The joint No. 1 is an Example of the present invention having a ferrite micro-structure area ratio of at least 20% in the HAZ. The joints Nos. 2 to 4 are Examples of the present invention whose ferrite micro-structure area ratio of the HAZ is at least 20% and whose carbon equivalent is not greater than 0.275. When the carbon equivalent became lower, the ferrite micro-structure area ratio increased, and the fatigue strength of the welded joints increased, too. The joints Nos. 17 and 18 are Comparative Examples whose ferrite micro-structure area ratio was lower and whose carbon equivalent was greater than those stipulated by the present invention, and the fatigue strength of these welded joints was lower than that of Examples 1 to 4 of the present invention.

The joints Nos. 5 to 16 are Examples of the present invention to which at least one of Cu, Ni, Cr, Mo, V, Nb, Ti, Ca and REM is added besides the basic components. Each of these Examples kept a high fatigue strength. The base metal strength was improved in the joints Nos. 5 to 11 and the ferrite micro-structure area ratio of the HAZ was improved due to fining of TiN or TiO in the joints Nos. 12 to 14.

On the other hand, the joints Nos. 19 and 20 are Comparative Examples to which these elements were added, but their ferrite micro-structure area ratio of the HAZ was low, and their carbon equivalent was greater than that stipulated in the present invention. The fatigue strength of these welded joints could not be improved.

On the other hand, in the joints Nos. 21 to 23 for which cruciform fillet-welding was carried out and in the joints Nos. 24 to 26 for which boxing welding was carried out, the fatigue strength of the welded joints could be improved when the ferrite area ratio of the HAZ was high.

Accordingly, in the welded joints satisfying the condition of the present invention (represented as "Examples of the present invention" in Table 2), the ferrite micro-structure area ratio was at least 20%, and all of these welded joints accomplished the excellent fatigue strength in the as-welded state.

TABLE 2

| Joint No. | Steel plate symbol | Sheet thickness T (mm) | Area ratio of HAZ structure (%) Ferrite structure | Other structure *3 | Joint Type | Fatigue strength *4 (MPa) | Remarks |
|---|---|---|---|---|---|---|---|
| 1 | A | 15 | 23 | 77 | T-type | 211 | Example of the present invention |
| 2 | B | 15 | 91 | 9 | " | 248 | Example of the present invention |
| 3 | C | 15 | 85 | 15 | " | 243 | Example of the present invention |
| 4 | D | 15 | 73 | 27 | " | 231 | Example of the present invention |
| 5 | E | 15 | 61 | 39 | " | 238 | Example of the present invention |
| 6 | F | 15 | 75 | 25 | " | 232 | Example of the present invention |
| 7 | G | 15 | 65 | 35 | " | 225 | Example of the present invention |
| 8 | H | 15 | 62 | 38 | " | 227 | Example of the present invention |
| 9 | I | 15 | 81 | 19 | " | 240 | Example of the present invention |
| 10 | J | 15 | 87 | 13 | " | 242 | Example of the present invention |
| 11 | K | 15 | 91 | 9 | " | 241 | Example of the present invention |
| 12 | L | 15 | 49 | 51 | " | 222 | Example of the present invention |
| 13 | M | 15 | 60 | 40 | " | 230 | Example of the present invention |
| 14 | M2 | 15 | 70 | 30 | " | 236 | Example of the present invention |
| 15 | N | 15 | 38 | 62 | " | 221 | Example of the present invention |
| 16 | O | 15 | 25 | 75 | " | 216 | Example of the present invention |
| 17 | P | 15 | 6 | 94 | " | 188 | Comparative example |
| 18 | Q | 15 | 7 | 93 | " | 191 | Comparative example |
| 19 | R | 15 | 5 | 95 | " | 192 | Comparative example |
| 20 | S | 15 | 16 | 84 | " | 193 | Comparative example |
| 21 | A | 6 | 65 | 35 | Cruciform | 216 | Example of the present invention |
| 22 | B | 6 | 93 | 7 | " | 218 | Example of the present invention |
| 23 | P | 6 | 6 | 94 | " | 174 | Comparative example |
| 24 | A | 30 | 61 | 39 | Boxing | 103 | Example of the present invention |

TABLE 2-continued

| Joint No. | Steel plate symbol | Sheet thickness T (mm) | Area ratio of HAZ structure (%) Ferrite structure | Other structure *3 | Joint Type | Fatigue strength *4 (MPa) | Remarks |
|---|---|---|---|---|---|---|---|
| 25 | B | 30 | 87 | 13 | " | 105 | Example of the present invention |
| 26 | P | 30 | 4 | 96 | " | 85 | Comparative example |

*3: area ratio as the sum of bainite/martensite/pearlite/residual austenite micro-structures
*4: fatigue strength at which the number of repetition of fracture reaches 2,000,000 times.

As described above in detail, the present invention increases the area ratio of the ferrite micro-structure capable of retarding the propagation speed of the fatigue crack in connection with the HAZ of the weld joint used for ships, offshore structures, bridges, building machines, etc., or to accomplish this object, the present invention limits the chemical components of the steel plate and its carbon equivalent and can therefore improve the fatigue strength of the welded joint. Therefore, when the welded joint of the present invention is employed, reliability to the fatigue destruction of the welded structures can be remarkably improved. The .technical significance of the welded joint of the present invention having such effects is extremely remarkable.

We claim:

1. A welded joint having an excellent fatigue strength characterized in that an area of a ferrite micro-structure in a heat affected zone of the welded joint is from 20 to 100% of the area of the heat affected zone, and the balance comprises at least one of a bainite, a martensite, a pearlite and a residual austenite micro-structure;

said welded joint being produced by using a steel plate containing 0.06 to 2.0 wt. % Si, and having a carbon equivalent (Ceg) of not greater than 0.275:

$$Ceg=C+Mn/6+(Cu+Ni)/15+(Cr+Mo+V)/5+Nb/3.$$

2. A welded joint having an excellent fatigue strength characterized in that an area of a ferrite micro-structure in a heat affected zone of the welded joint is from 20 to 1000 of the area of the heat affected zone, and the balance comprises at least one of a bainite, a martensite, a pearlite and a residual austenite micro-structure;

said welded joint being produced by using a steel plate containing, in terms of percent by weight:

C: 0.015 to 0.15%,

Si: 0.06 to 2.0%,

Mn: 0.2 to 1.5%,

P: not greater than 0.05%,

S: not greater than 0.05%,

Al: 0.001 to 0.08%,

N: 0.002 to 0.015%, and the balance of Fe and unavoidable impurities; and having a carbon equivalent (Ceq) of not greater than 0.275:

$$Ceq=C+Mn/6+(Cu+Ni)/15+(Cr+Mo+V)/5+Nb/3.$$

3. A welded joint having an excellent fatigue strength according to claim 2, which is produced by using a steel plate further containing, in terms of percent by weight:

Ti: 0.003 to 0.05%.

4. A welded joint having an excellent fatigue strength according to claim 3, which is produced by using a steel plate having a value Ti/N is 2.0 to 3.4.

5. A welded joint having an excellent fatigue strength according to claim 2, which is produced by using a steel plate further containing, in terms of percent by weight, at least one of the following members:

Cu: 0.1 to 2.0%,

Ni: 0.1 to 2.0%,

Cr: 0.05 to 1.0%,

Mo: 0.02 to 1.0%,

V: 0.005 to 0.10%, and

Nb: 0.005 to 0.08%.

6. A welded joint having an excellent fatigue strength according to claim 2, which is produced by using a steel plate further containing, in terms of percent by weight:

Ca: 0.0005 to 0.010%, and

REM: 0.0050 to 0.050%.

* * * * *

UNITED STATES PATENT AND TRADEMARK OFFICE

CERTIFICATE OF CORRECTION

PATENT NO. : 5,964,964
DATED : October 12, 1999
INVENTOR(S) : Katsumi KUREBAYASHI, et al.

It is certified that error appears in the above-identified patent and that said Letters Patent is hereby corrected as shown below:

FRONT, second line under "Foreign Application Priority Data", change DDec. 6, 1996" to --March 12, 1996--.7

Signed and Sealed this

Seventeenth Day of April, 2001

*Attest:*

*Attesting Officer*

Nicholas P. Godici

NICHOLAS P. GODICI

*Acting Director of the United States Patent and Trademark Office*